US006213283B1

(12) United States Patent
Bailey et al.

(10) Patent No.: US 6,213,283 B1
(45) Date of Patent: Apr. 10, 2001

(54) APPARATUS FOR TRANSFERRING ROD-LIKE ARTICLES

(75) Inventors: Thomas William Bailey; Brian Hill, both of Coventry; Robert Howard Taylor, Bucks, all of (GB)

(73) Assignee: Molins PLC, Milton Keyne (GB)

( * ) Notice: Subject to any disclaimer, the term of this patent is extended or adjusted under 35 U.S.C. 154(b) by 0 days.

(21) Appl. No.: 09/308,347

(22) PCT Filed: Nov. 19, 1997

(86) PCT No.: PCT/GB97/03167

§ 371 Date: May 19, 1999

§ 102(e) Date: May 19, 1999

(87) PCT Pub. No.: WO98/22349

PCT Pub. Date: May 28, 1998

(30) Foreign Application Priority Data

Nov. 20, 1996 (GB) ..... 9624110

(51) Int. Cl.[7] ..... B65B 19/10

(52) U.S. Cl. ..... 198/418.2; 198/418.3; 198/471.1

(58) Field of Search ..... 198/418.2, 418.3, 198/471.1, 450; 131/282

(56) References Cited

U.S. PATENT DOCUMENTS

| | | | | |
|---|---|---|---|---|
| 3,603,445 | * | 9/1971 | Bailey et al. | 198/471.1 |
| 4,364,464 | * | 12/1982 | Manservisi et al. | 198/418.3 |
| 4,614,263 | * | 9/1986 | Nagata et al. | 198/418.3 |
| 4,711,339 | * | 12/1987 | Nagata et al. | 198/418.3 |
| 5,860,506 | * | 1/1999 | Bailey et al. | 198/471.1 |

* cited by examiner

*Primary Examiner*—Robert P. Olszewski
*Assistant Examiner*—Thuy V. Tran
(74) *Attorney, Agent, or Firm*—Antonelli, Terry, Stout & Kraus, LLP

(57) ABSTRACT

Apparatus for transferring rod-like articles such as cigarettes comprising a series of hoppers (2, 4, 6) which deliver rows of cigarettes to fluted planetary wheels (8, 10, 12) which are mounted on a rotating carrier and driven around a central drum (20), by gearing between the planet wheels and the drum. The drum is provided with pockets (22, 24) etc each of which is three rows deep so as to accommodate the output from three of the planet wheels. In this way the cigarettes are grouped into bundles for subsequent packaging.

20 Claims, 11 Drawing Sheets

APPARATUS FOR TRANSFERRING ROD-LIKE ARTICLES

This invention relates to transferring rod-like articles, particularly transferring rows of cigarettes for subsequent packing in a cigarette packing machine.

In order to achieve higher speeds in cigarette packing machines it is desirable that as many parts of the machine as possible should operate continuously rather than intermittently. In particular it is desirable that the conveyor in which the groups of cigarettes are assembled into bundles for subsequent wrapping should run continuously. The present invention is particularly but not exclusively concerned with transfer apparatus suitable for feeding cigarettes to such a conveyor, particularly from a hopper or other region in which the cigarettes are substantially stationary.

According to one aspect of the invention apparatus for transferring rod-like articles includes means for supplying articles to a plurality of adjacent delivery positions arranged in a row, rotary conveyor means including means for receiving articles from said positions, the rotary conveyor means comprising a plurality of planetary wheels each having receiving means defining individual article positions; an annular carrier for translating said wheels along a path extending adjacent said row so that said receiving means receives articles from said positions; and a sun wheel having means defining grouped article positions each of which is adapted to receive articles in successive layers from said planetary wheels.

Preferably, the adjacent delivery positions are defined by a series of vanes defining rows in the outlet of a hopper, and each planetary wheel is provided with at least one set of flutes defining the individual article positions, the number of flutes in the or each set corresponding to the number of rows in the outlet of the hopper.

Preferably, the sun wheel is in the form of a drum, having pockets defining the grouped article positions, and the planets are mounted in a carrier and are geared to the outside of the sun wheel and to a fixed ring gear, so that rotation of the drum causes the planets to rotate on their own axes, and also drives the planet carrier round the drum. The gearing is such that the or each set of flutes on each planet coincides in position with a set of outlet vanes on the hopper when the articles are to be received, and also co-operates with the pockets on the drum, when they are to be delivered.

Preferably, each pocket on the drum is sufficiently deep to accommodate a plurality of layers of articles, each layer corresponding to one set of flutes on the planets, and the arrangement is such that each pocket receives a row of articles from one of the planet wheels, which is laid down into the pocket as the planet wheel passes it.

In a preferred embodiment of the invention, there is at least one set of three hopper delivery positions, and the pockets are three layers deep, the position and gearing of the planet wheels being such that successive layers of articles are transferred into each pocket, by the planet wheels, as they pass by each hopper delivery position.

Some embodiments of the invention will now be described by way of example, with reference to the accompanying drawings, in which.

Figure 1:
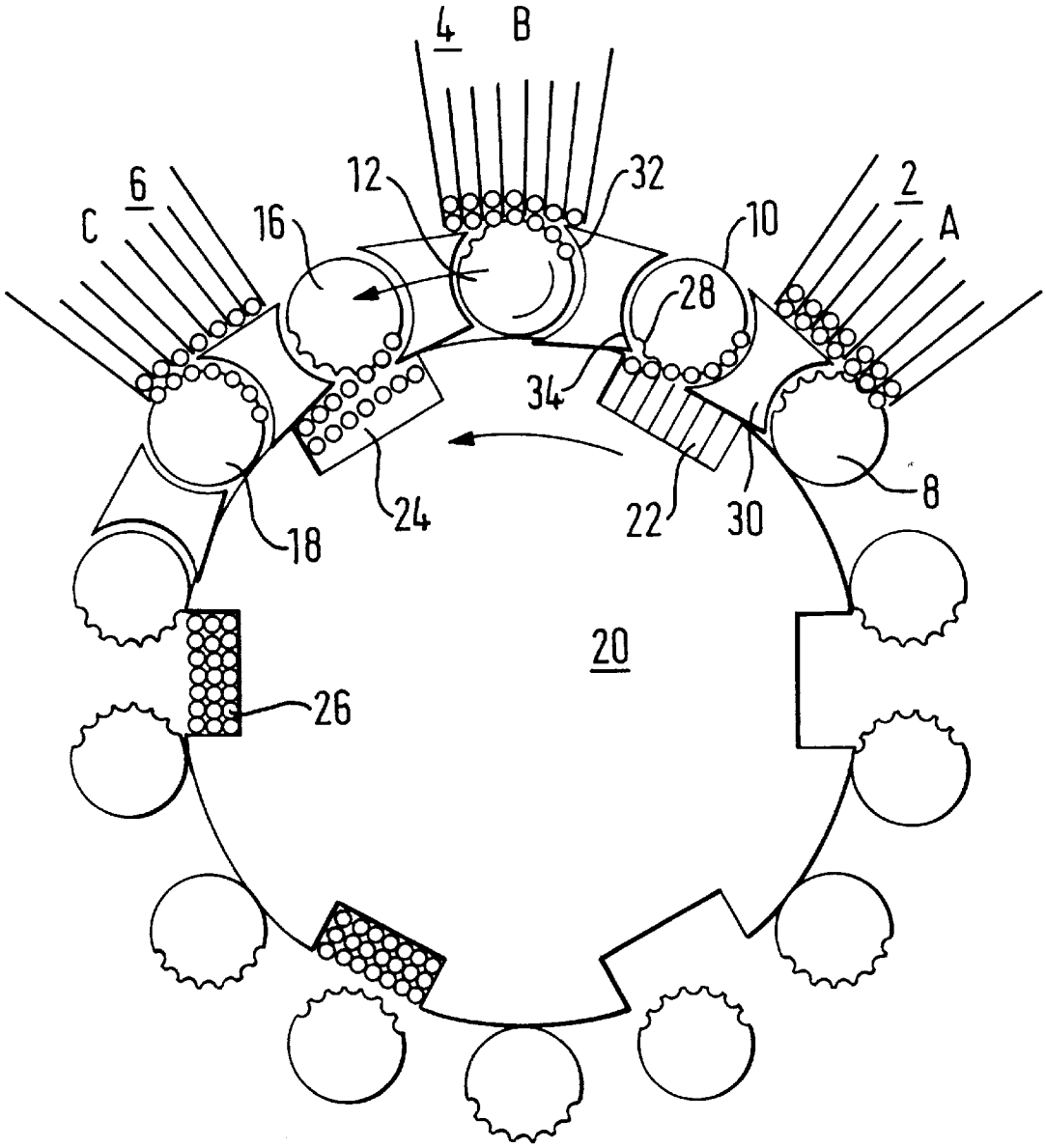
FIG. 1 is a schematic view of a first type of hopper, planet and drum arrangement.

FIG. 1 shows a first embodiment of the invention, in which cigarettes are fed from three hoppers, 2, 4 and 6, each of which has internal vanes defining a row of seven adjacent outlet positions. Each row of cigarettes is received by a row of flutes on a planetary wheel 8, 10, 12 etc, the planetary wheels being mounted on a rotating carrier and driven around a central drum 20, by gearing which connects the planet wheels to the drum. The drum is provided with pockets 22, 24 etc, each of which is three rows deep, so as to accommodate the output from three of the planet wheels.

Describing the operation of this embodiment in more detail, it will be seen from a consideration of the position of planet wheels 8 and 10 in the drawing, that the planet wheel 10 has just passed the hopper 2, and has received a row of cigarettes from it, which are then held in flutes 28 on its surface by suction, until it rotates to a position in which it is above the leading edge of pocket 22. At this stage, the suction on each of the flutes is successively cut off, so that the cigarette will be deposited into the pocket 22 in a row which will fall (or preferably be guided, as described below) into the bottom of the pocket. A suitable arrangement for controlling the suction is shown in more detail in WO95 21771.

Subsequently, as the drum continues to rotate, the pocket 22 will arrive at a position beneath a further planet wheel, in the position indicated at 16, which has previously collected a row of cigarettes from hopper 4, and this will result in a second row being transferred into the pocket, as indicated at 24. Similarly, the third row of cigarettes, taken from the hopper 6, will have been added to the pocket to completely fill it, by the time it reaches position 26.

In this arrangement there are six pockets in the drum, and 14 fluted planets equi-spaced around it. The planets are geared to the outside of the drum and to a fixed ring gear, and suitable gearing is used to ensure that the flutes on each planet always match the rows defined by the hopper vane, and deliver the cigarettes to the pockets on the drum in suitable positions.

It will be appreciated that any number of pockets on the drum can be catered for, by use of a suitable number of planets and gear ratios.

The drawing also illustrates the use of guides 30, mounted on the carrier between the planet wheels, which are suitably shaped to guide the cigarettes from the hopper output onto the flutes of the planetary wheels, as for example, indicated at 32, and also to guide the cigarettes from the flutes of the planet wheel, into each pocket, as indicated at 34 on the drawing.

Figure 2:
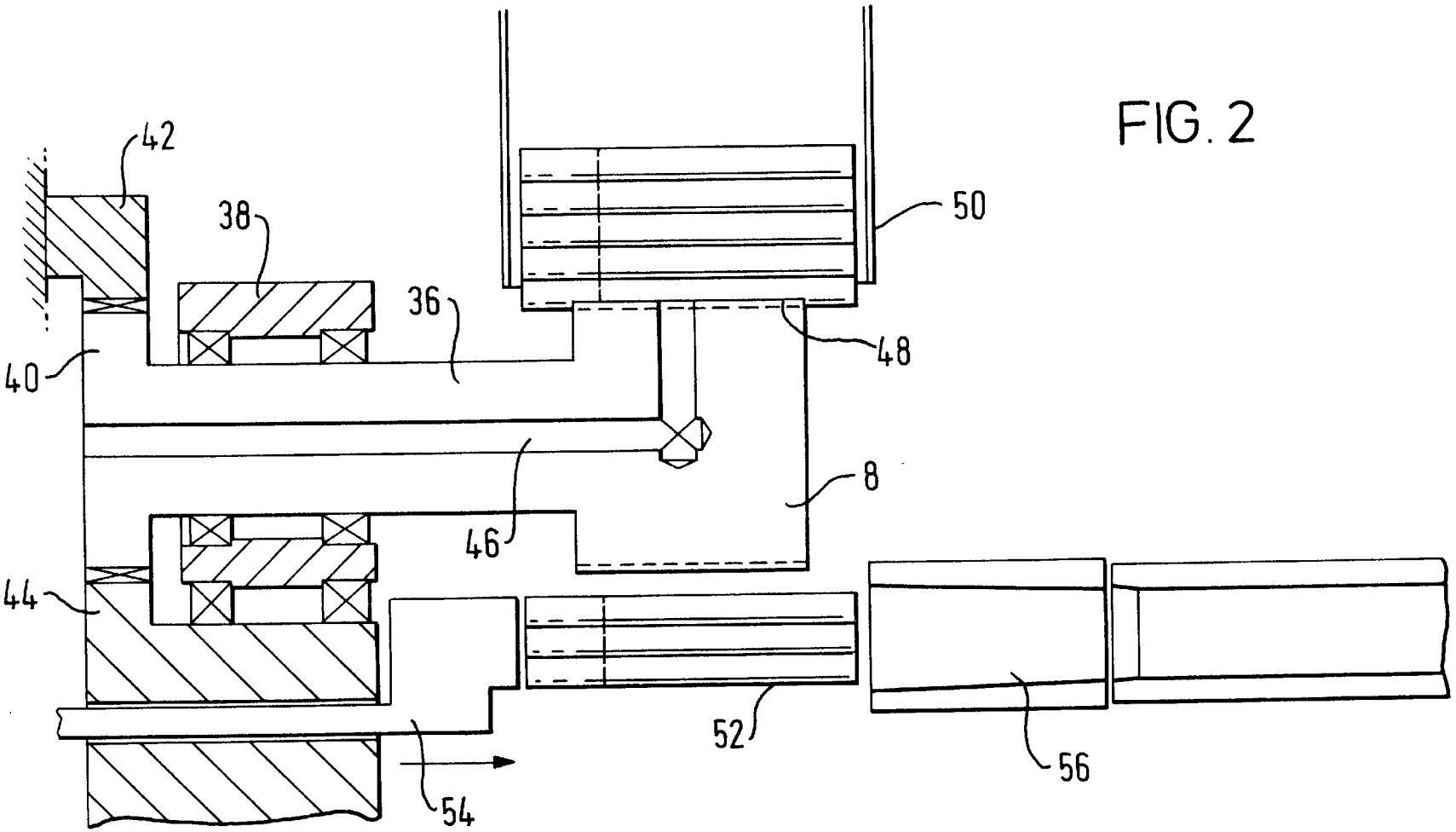
FIG. 2 is a cross-section through a hopper planet and drum pocket of the machine shown in FIG. 1.

Referring to FIG. 2, each planet wheel 8, 10 etc is mounted by means of a shaft 36 in the planet carrier 38, and a gear 40 on the other end of the shaft engages with a ring gear 42 on one side, and a sun gear 44 on the other side. A vacuum pipe 46 in the shaft 36 communicates with the flutes 48 of the planet wheel, so that cigarettes can be taken from the hopper 50, and supplied to the pocket 52 on the drum.

Subsequently, a plunger 54 transfers the bundle formed in the pocket 52, into a collating box 56 for transfer onto a pocketed belt, chain or drum so that it can be transported to the next stage of the operation.

Figure 3:
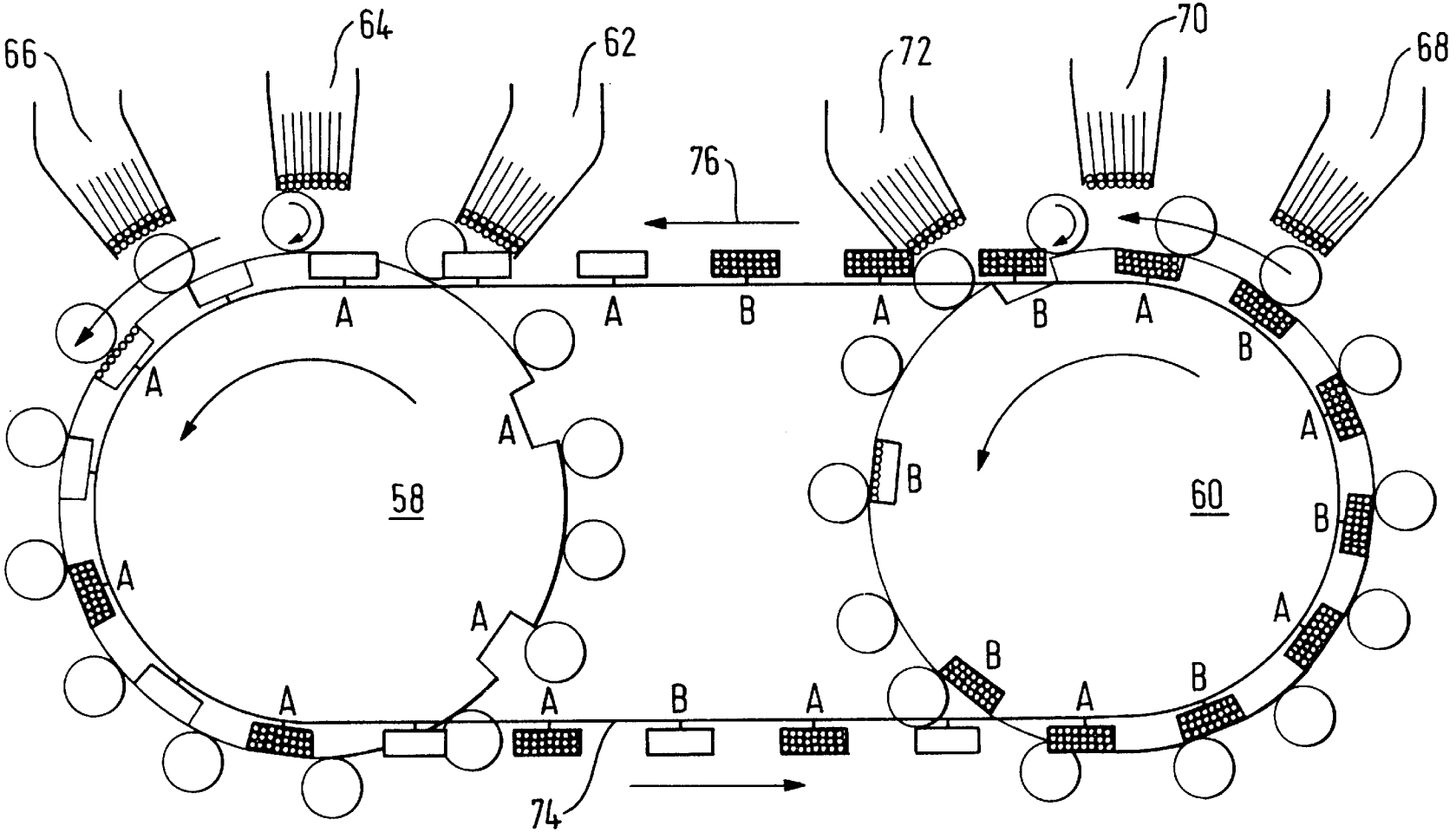
FIG. 3 is a schematic view corresponding to the view of FIG. 1, for an alternative construction having two drums.

FIG. 3 shows an arrangement in which there are two drums 58 and 60, each of which is fed by a set of three hopper outputs 62, 64, 66, and 68, 70, 72. This arrangement reduces the risk of starvation in the hopper vanes, by allowing the speed of cigarettes in each hopper vane to be reduced by 50%. In this arrangement, the first drum 58 lays up cigarettes in pockets A on the drum, and the bundles are then transferred axially into a belt system 74 which also passes around the second drum 60, where alternate pockets B are filled, and the belt then transfers the completely filled sets of pockets onto the next stage of the process at the regions 76, before returning to the drum 58. It will be appreciated that the belt system 74 could also be replaced by a pocketed chain, for example.

Figure 4:
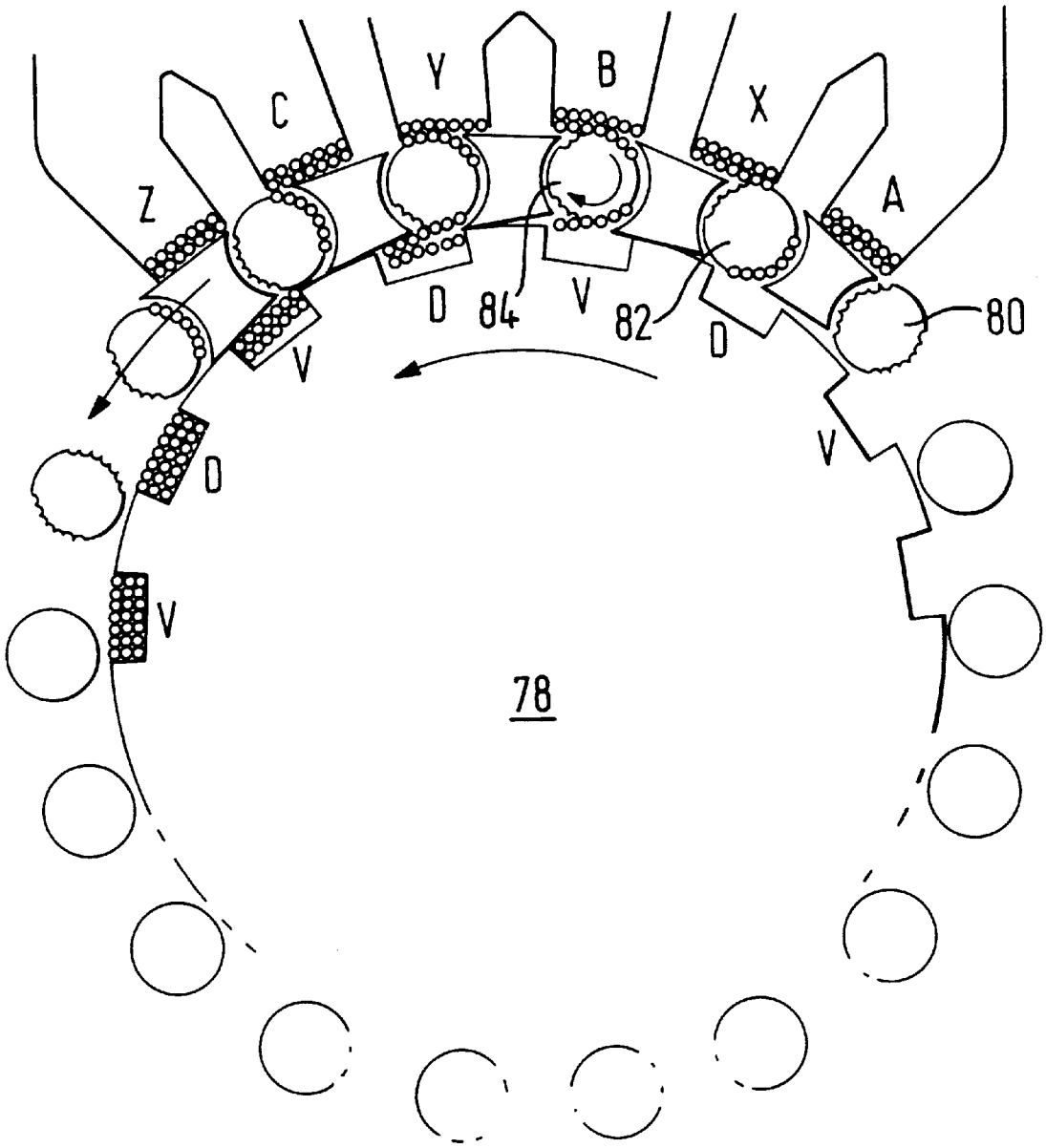
FIG. 4 is a similar schematic view, but showing an arrangement having two sets of three hoppers.

Another possible arrangement for reducing the speed of cigarettes in the vanes of the hopper is illustrated in FIG. 4, in which there is a single drum 78, having two sets of hoppers A, B, C and X, Y, Z. Each planet wheel 80, 82, 84 etc has two sets of flutes in its periphery, one of which is geared to meet with hoppers A, B, & C, whilst the other is geared to meet with hoppers X, Y, Z. With suitable gearing, this enables hoppers A and X to supply cigarettes for the first layer in each pocket, hopper B and Y to supply cigarettes for the second layer, and hoppers C and Z to supply cigarettes for the third layer in the pocket, as will be clear from the drawing. The arrangement is such that each set of flutes on each planet wheel delivers to alternate pockets on the drum, and in the combination shown there are 16 pockets on the drum and 18 equi-spaced planet wheels.

As an alternative it will be appreciated that if there were three sets of hopper outlets and each planet had three sets of flutes then each of the three layers to be received in a pocket could be identified uniquely with a flute set, i.e. there could be three sets of flutes on each planet respectively with 7, 6 and 7 cigarette positions for a standard 20 collation. Of course, in order to provide room for nine hopper outlets the drum would need to be relatively large in order to avoid having the outer hopper outlets too far displaced from a vertical position.

Figure 5:
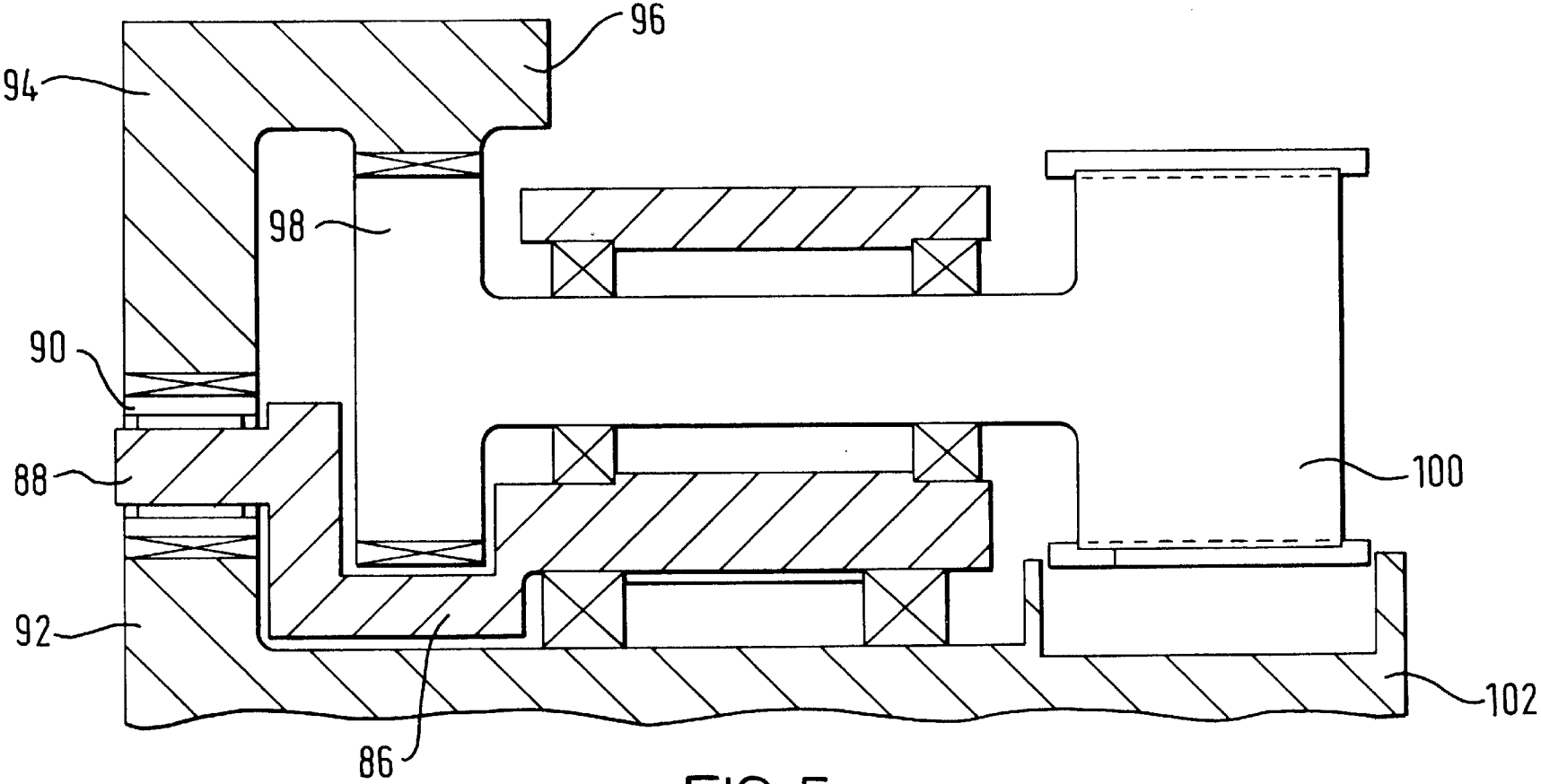
FIG. 5 is a cross-section through a differential drive system for the planet wheels.

FIG. 5 illustrates a differential drive speed system, which helps to prevent a cigarette from jamming between the parts of the mechanism.

This happens because each planet wheel is effectively rolling around the pitch diameter of the hoppers, and thus the relative motion of each planet to a cigarette in the hopper is momentarily zero. In addition, the planet is also rolling around the pitch diameter of the drum so that relative motion of the planet to the drum is also momentarily zero.

However, the cigarettes in the hoppers are spaced apart to allow for clearances such as the width of the vane material, and in a typical case, the effective cigarette spacing is 9 mm around the planet, resulting in the cigarettes being transferred to the drum at 9 mm spacing. Without vanes in the pockets on the drum, this amount of clearance build up could allow the cigarettes to jam and get misaligned.

In order to prevent this happening, the planet wheel can be run at a higher surface speed than the surface speed of the drum so that the spacings close up, for example, for ten cigarette spacings of 9 mm on the planet (pitch length 90 mm) drum rotation should equal 10 cigarette spacings of 8 mm.=80 mm. In order to achieve this, as shown in FIG. 5, the planet carrier 86 is formed with a number (typically, three) of axially extending mounting shafts 88 equi-spaced around its circumference, which are journalled in planet gears 90 running around the sun gear 92. A ring gear 94, mounted externally of the planet gears, engages with the planet gears and carries a further ring gear 96, having a larger internal diameter, and a planet driving gear 98 is driven in turn by the gear 96.

This arrangement allows the planets 100 to run at a higher surface speed than the drum 102, thus causing the spacing of the cigarettes to close up.

Thus in the example shown, for spacings closed from 9 mm to 8 mm, the speed difference is 12½%.

Figure 6:
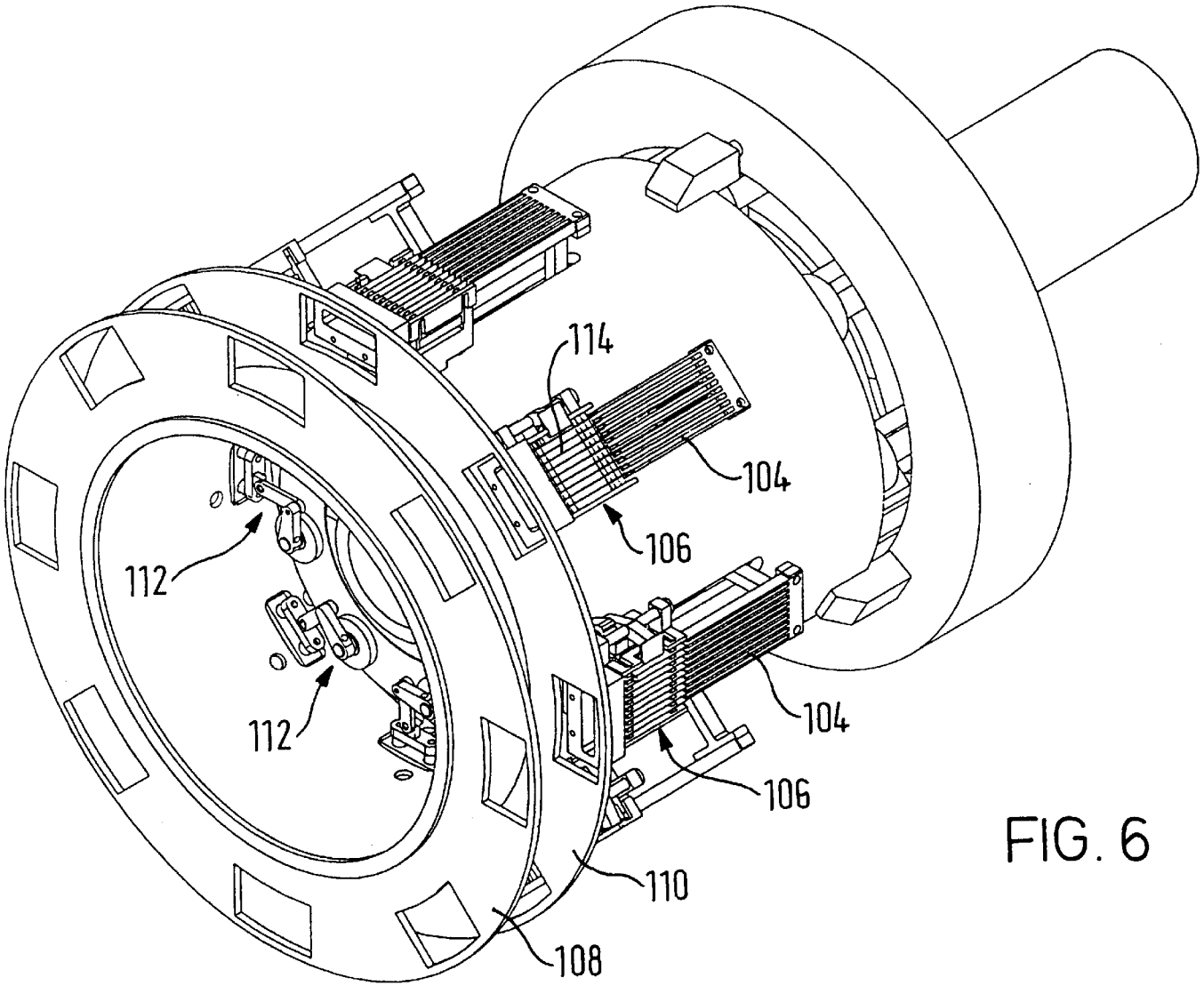
FIG. 6 is a perspective view of a drum assembly of the same general kind as shown in FIG. 1.

Referring to FIG. 6, a typical drum construction is shown in which there are 8 pockets, and it will be seen that the drum also carries assemblies of plungers 104 which operate to transfer the cigarettes from the pockets 106 of the drum, into the pockets of a conveyor (not shown) which runs between a pair of flanges 108 and 110 on the outer end of the drum.

Figure 7:
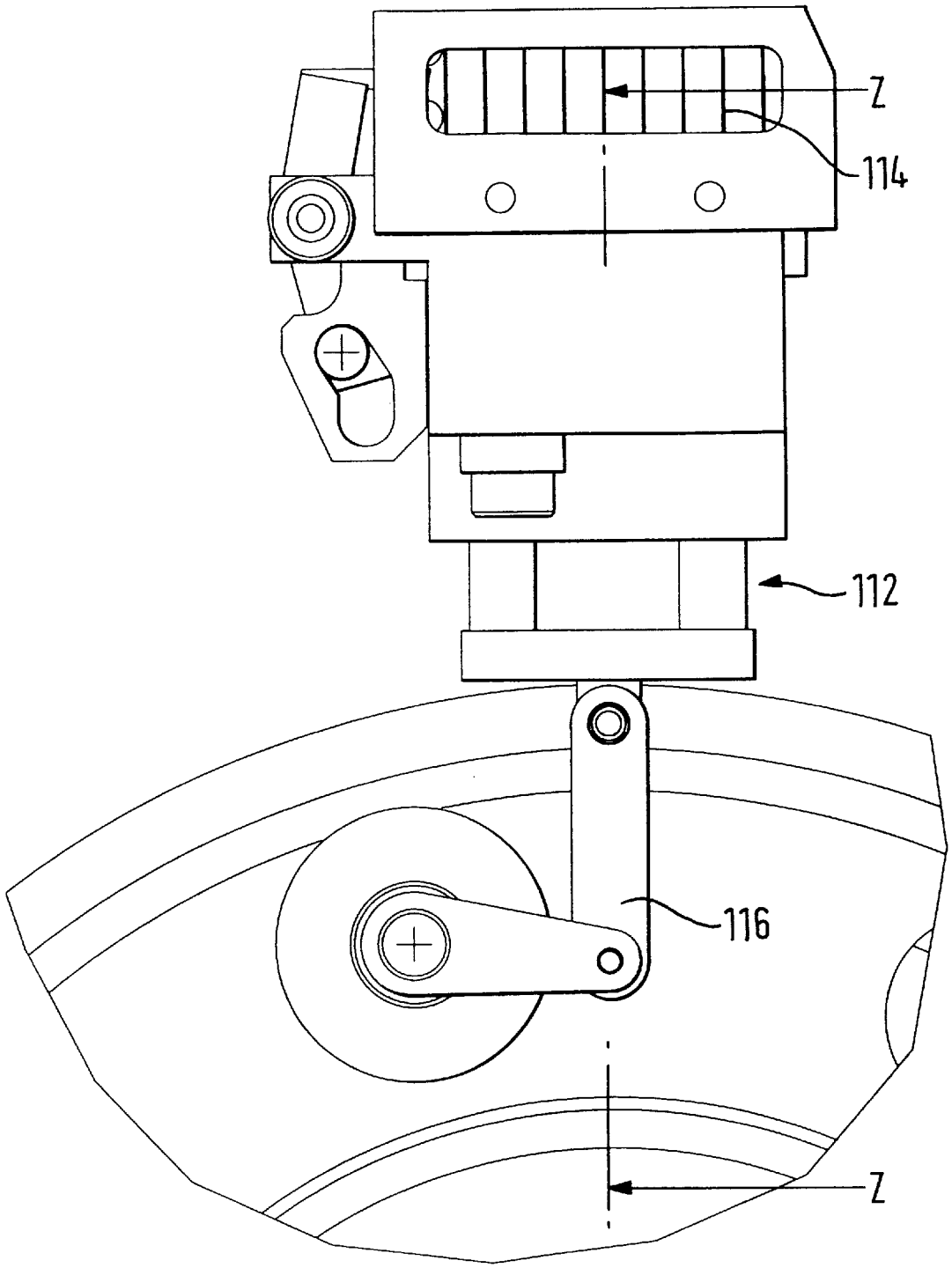
FIG. 7 is an axial view of a part of the mechanism of FIG. 6.
Figure 8:
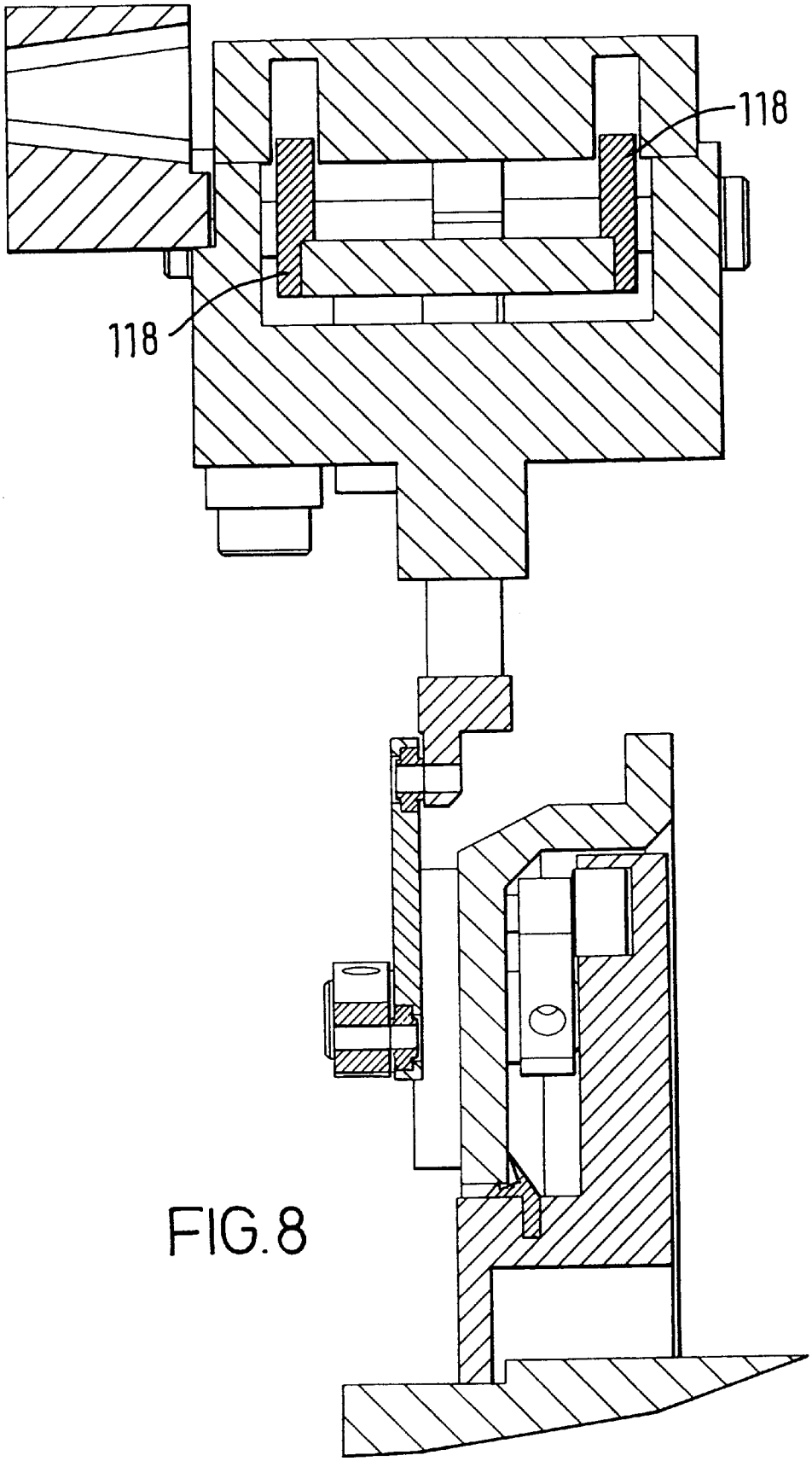
FIG. 8 is a cross-section taken along the lines Z—Z of FIG. 7.

As will be clear from FIGS. 6 and 7, the drum pocket of the embodiment shown includes vanes 114 to properly locate the individual cigarettes received from the flutes of the planet wheels, but in order to ensure that the cigarettes are properly laid down in each position, without jamming, it is necessary to provide a retractable support in each pocket, which moves lower into the pocket as the drum rotates, and as successive layers are laid into the pocket. Accordingly, the support mechanism 112 is driven by a retractable link mechanism 116 in such a way that a pair of support arms 118 can be progressively lowered into the pocket, as the drum rotates. As will be appreciated from a consideration of the diagrammatic views of FIG. 1 or 4, for example, the same effect could also be achieved by means of a circular "ramp" like profile extending around the drum, so as to form an inwardly spiralling surface.

Figure 9:
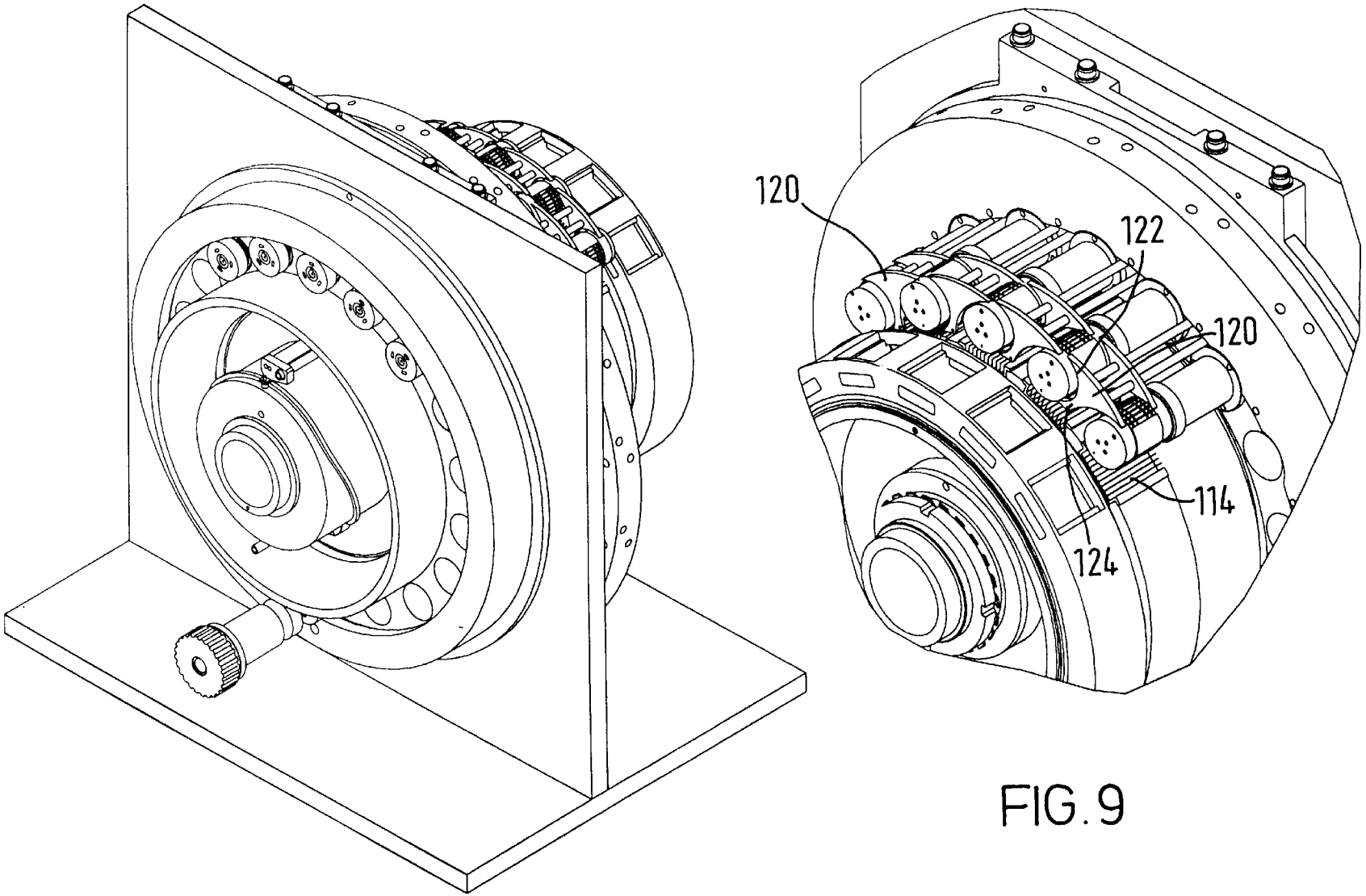
FIG. 9 is a partial perspective view showing the planet wheels of a drum assembly having 18 planet wheels.

The perspective view of FIG. 9 illustrates in somewhat more detail, how plate-like guide members 120 are mounted between adjacent planet wheels. As will be clear from the drawing, the upper leading corner 122 of the guide 120 is so shaped that it helps to guide the cigarettes out of the hopper onto the flutes of the planetary wheel, as the drum rotates in a counter-clockwise direction, while the lower leading corner 124 of the guide acts to support the cigarettes as they leave the flutes of the wheel, and enter the guide vanes 114 of the pocket.

Figure 10:
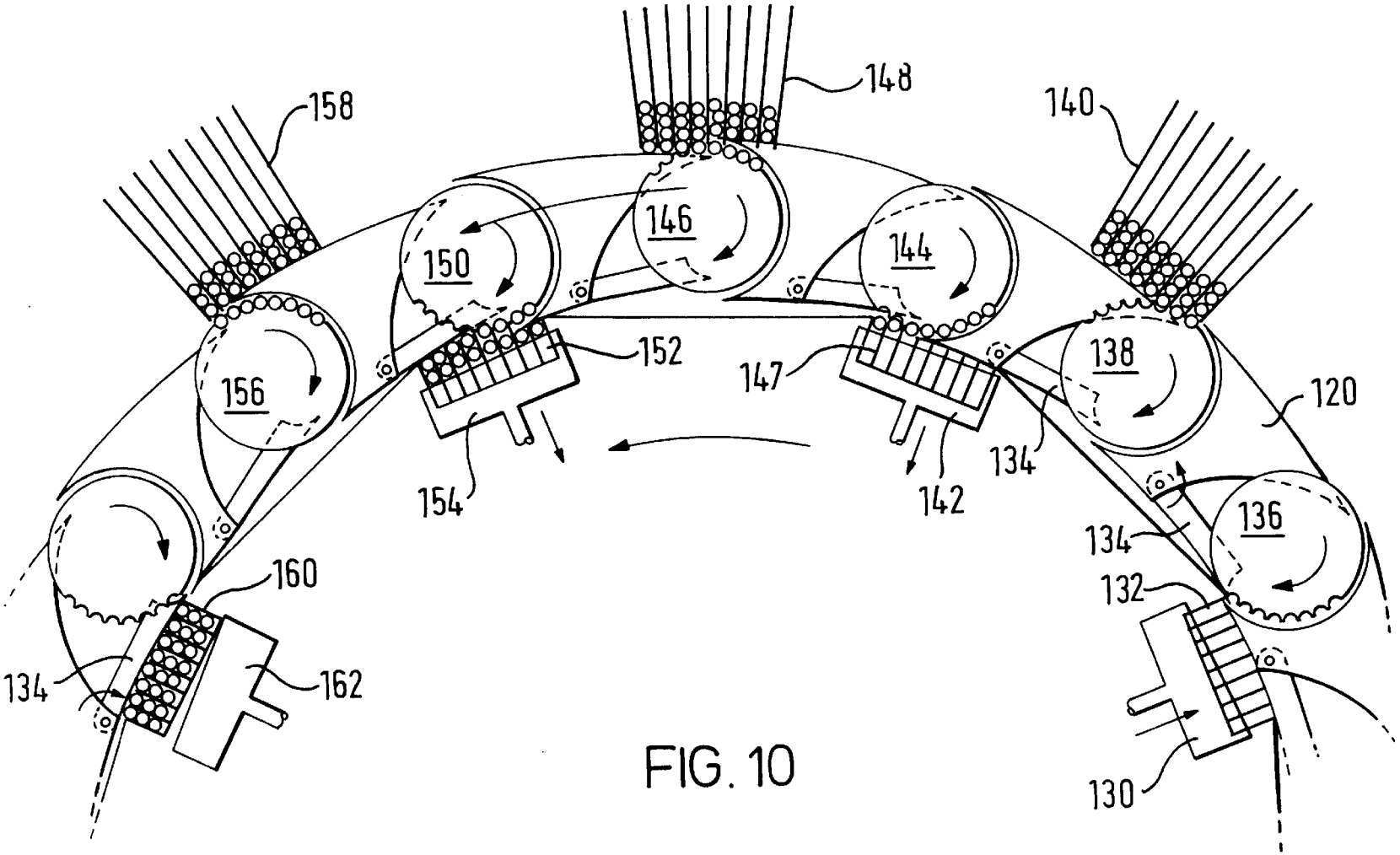
FIG. 10 is a partial elevational view of the machine of FIG. 9, showing the transfer sequence in more detail.

FIG. 10 illustrates in more detail, the transfer path of each row of cigarettes from the bottom of the hopper, into the drum pocket, for an arrangement having 18 planet wheels and 8 pockets.

Starting from the righthand side of the drawing, a lifter assembly 130 is radially extended to support incoming cigarettes in the pocket 132, and a pivoted guide member 134 attached to the guide plate 120 is rotated in an anti-clockwise direction, in preparation for cigarette feed from the adjacent planet wheel 136. The next anti-clockwise position 138 of the planet wheel shows the guide 134 in the open position, and cigarettes are beginning to enter the flutes of the planet wheel, from the hopper 140.

In the next counter-clockwise position the lifter assembly 142 is beginning to retract back towards the centre of the sun wheel, as cigarettes from the flutes of the planet 144 are beginning to enter the vanes of the pocket 147, so that they will be supported in the correct alignment, in the continually increasing gap between the lifter and the planet wheel.

The next counter-clockwise planet wheel 146 is shown in the process of receiving a row of cigarettes from the following hopper 148, and thus, at the next planet wheel position 150, the pocket 152, which already contains a first row of cigarettes, supported by the partially retracted lifter 154, receives a second row of cigarettes from the overlying planet wheel. The third row is added in a similar fashion by the planet wheel 156, from the hopper 158, and thus by the time the pocket has reached the position 160 at the lefthand side of the drawing, it contains three rows of cigarettes, and the lifter 162 has been retracted out of engagement with the lowest row of cigarettes. At the same time, the inner guide 134 is rotated back in a clockwise direction to retain the cigarettes in the pockets.

Figure 11:
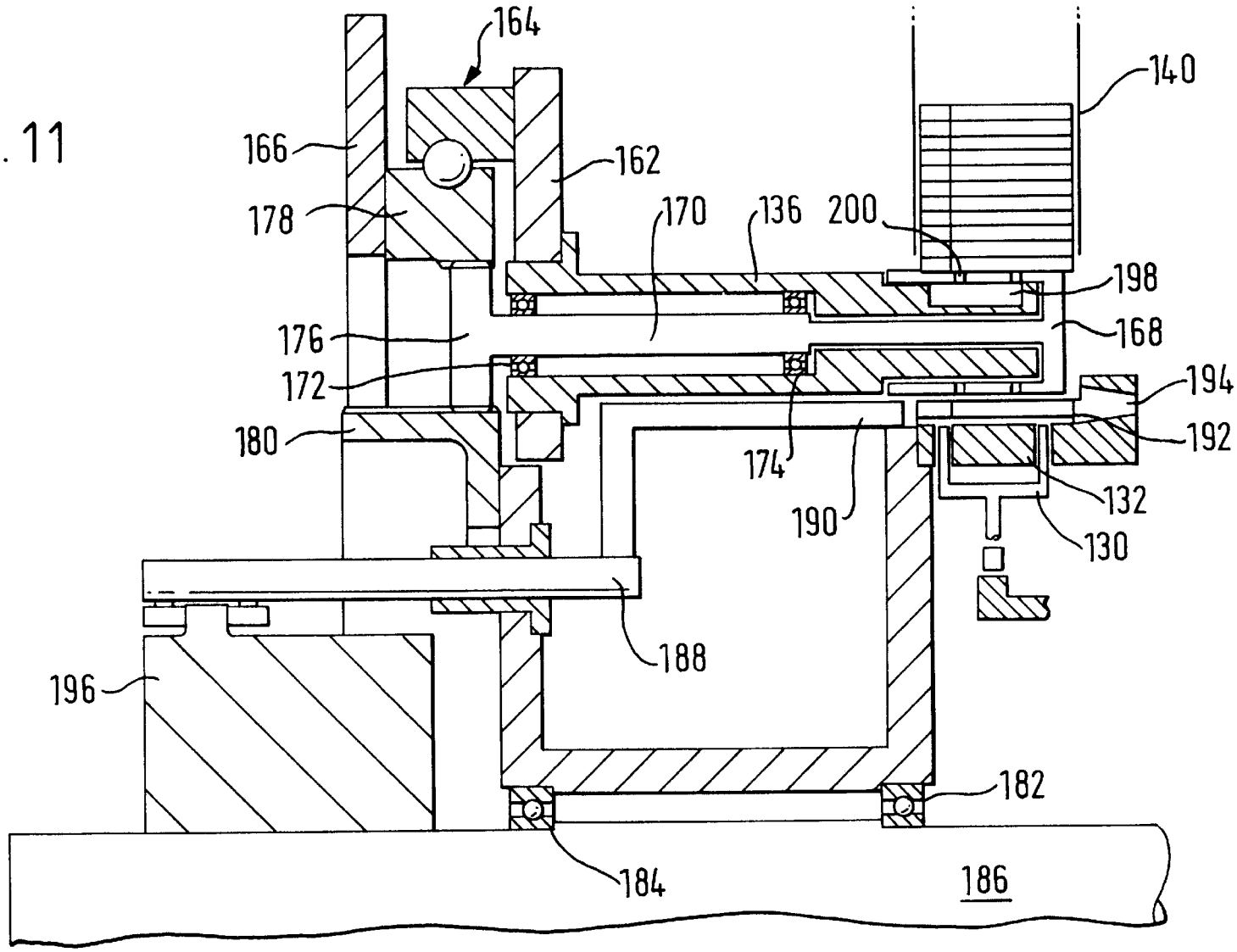
FIG. 11 is a cross-section through the hopper, planet assembly and drum pocket of the machine of FIGS. 9 and 10.

Referring to the cross-sectional drawing of FIG. 11, this shows the mechanism in a position in which the lifter 130, pocket 132, planet wheel 136, and hopper 140 are aligned with one another, and it will be seen that the planet assembly 136 is fixed to a carrier plate 162, which runs on a bearing assembly 164 mounted on a fixed frame 166 of the machine. The planet itself comprises a shell 168 mounted on a shaft 170, journalled in bearings 172 and 174 in the planet assembly 136, and driven around by planet gear 176 which is engaged between a fixed ring gear 178 and a sun gear 180 on the rear periphery of the sun assembly itself. This in turn is journalled on bearings 182, 184, on the central shaft 186 of the machine. In the typical arrangement shown, the pitch circles for the planet gear, the ring gear, and the sun gear are 99 mm, 990 mm and 792 mm, and there are 8 pockets at a spacing of 45° and 18 planets at a spacing of 20°.

This results in a carrier speed of 4/9ths times the sun speed, and a planet speed of 10 times the carrier speed. When the sun wheel rotates 45°, i.e. one pocket pitch, the carrier has advanced 4/9th times 45°, i.e. 20° or one planet position. In this way, the pockets are suitably aligned to receive cigarettes from the next planet wheel, each time they have moved through 45° (see FIG. 10).

As illustrated in the drawing, suction for the flutes of the planet wheel is applied via a manifold 198 and co-operating ports 200 in the shell 168

FIG. 11 also illustrates the arrangement of the collation plunger 188 having fingers 190 which are arranged to eject the collation 192 from the pocket, into a collation mouthpiece 194 when the pocket is full, the operation being controlled by a fixed plunger cam 196.

What is claimed is:

1. Apparatus for transferring rod-like articles comprising means for supplying articles to a plurality of adjacent delivery positions arranged in a row, rotary conveyor means including means for receiving articles from said positions, the rotary conveyor means comprising a plurality of planetary wheels each having receiving means defining individual article positions; an annular carrier for translating said wheels along a path extending adjacent said row so that said receiving means receives articles from said positions; and a sun wheel having means defining grouped article positions each of which is adapted to receive articles in successive layers from said planetary wheels.

2. Apparatus according to claim 1 in which the adjacent delivery positions are defined by a series of vanes defining rows in the outlet of a hopper, and each planetary wheel is provided with at least one set of flutes defining the individual article positions, the number of flutes in the or each set corresponding to the number of rows in the outlet of the hopper.

3. Apparatus according to claim 1 in which the sun wheel is in the form of a drum, having pockets defining the grouped article positions, and the planets are mounted in a carrier and are geared to the outside of the sun wheel and to a fixed ring gear, so that rotation of the drum causes the planets to rotate on their own axes, and also drives the planet carrier round the drum.

4. Apparatus according to claim 3 in which the gearing is such that the or each set of flutes on each planet coincides in position with said delivery positions when the articles are to be received, and also co-operates with the pockets on the drum, when they are to be delivered.

5. Apparatus according to claim 3 in which each pocket on the drum is sufficiently deep to accommodate a plurality of layers of articles, each layer corresponding to one set of flutes on the planets, and the arrangement is such that each pocket receives a row of articles from one of the planet wheels, which is laid down into the pocket as the planet wheel passes it.

6. Apparatus according to claim 3 in which there is at least one set of three hopper delivery positions, and the pockets are three layers deep, the position and gearing of the planet wheels being such that successive layers of articles are transferred into each , pocket, by the planet wheels, as they pass by each hopper delivery position.

7. Apparatus according to claim 1 including endless conveyor means having a path adjacent said sun wheel, said conveyor means having a series of group pockets for receiving groups of articles, and means for transferring groups of articles from said grouped article positions of said sun wheel to said group pockets.

8. Apparatus according to claim 7 including a further sun wheel having grouped article positions adjacent said path, and means for transferring groups of articles from said grouped article positions of said further sun wheel to said group pockets, whereby at least some of said group pockets receive groups of articles from said sun wheel and at least some others of said group pockets receive groups from said further sun wheel.

9. Apparatus as claimed in claim 1 in which there is a plurality of sets of adjacent delivery positions, and the planetary wheels and grouped article positions are so arranged that successive layers of articles received in a group article position are received from different sets.

10. Apparatus according to claim 9 in which the sets of article delivery positions are arranged in at least two groups, and the planetary wheels and grouped article positions are so arranged that successive layers of articles received in a group article position are received from sets in the same group and successive grouped article positions receive articles from sets in different groups.

11. Apparatus according to claim 1 including means for driving said annular carrier at a speed which differs from the peripheral speed of the sun wheel, whereby the spacing between articles may be changed on delivery from said planetary wheels to said grouped article positions.

12. Apparatus according to claim 1 in which the article delivery positions and the individual article positions of said planetary wheels have a first spacing, and articles are received in said grouped article positions at a second spacing which is less than said first spacing.

13. Apparatus according to claim 1 including further article position defining means within said grouped article positions of said sun wheel.

14. Apparatus as claimed in claim 13 in which said further article position defining means includes at least one partition extending in a radial direction of said sun wheel.

15. Apparatus according to claim 1 including means defining a receiving level for said grouped article positions relative to said planetary wheels, and means for maintaining said level constant with no or different numbers of articles in said positions.

16. Apparatus according to claim 15 in which the level maintaining means comprises support means for the lowermost layer received at a grouped article position.

17. Apparatus according to claim 16 in which the support means comprises a stationary surface cooperating with said grouped article positions and having differing radial levels at different positions relative to the axis of said sun wheel.

18. Apparatus according to claim 17 in which said surface assumes a radially inner position relative to said sun wheel to accommodate at least one layer of articles in a recessed group article position on said wheel and to allow a further layer to be received on said one layer at a different rotational position of said wheel.

19. Apparatus according to claim 16 in which the support means comprises a surface movable with said sun wheel, and means for moving said surface in a radial direction relative to said wheel.

20. Apparatus according to claim 19, in which said surface assumes a radially inner position relative to said sun wheel to accommodate at least one layer of articles in a recessed group article position on said wheel and to allow a further layer to be received on said one layer at a different rotational position of said wheel.

* * * * *